United States Patent [19]

Moriguchi et al.

[11] 4,444,833

[45] Apr. 24, 1984

[54] HEAT-TRANSFER RECORDING MEDIUM

[75] Inventors: Haruhiko Moriguchi; Takashi Ohmori, both of Kanagawa, Japan

[73] Assignee: Fuji Xerox Co., Ltd., Tokyo, Japan

[21] Appl. No.: 356,542

[22] Filed: Mar. 9, 1982

[30] Foreign Application Priority Data

Mar. 13, 1981 [JP] Japan ..... 56-35247

[51] Int. Cl.[3] ..... B41M 5/18

[52] U.S. Cl. ..... 346/204; 427/153; 428/913; 428/914; 346/208

[58] Field of Search ..... 282/27.5; 428/320.8, 428/488, 913, 914, 411, 537; 427/150–153

[56] References Cited

U.S. PATENT DOCUMENTS 4,112,138 9/1978 Davis et al. ..... 282/27.5

4,162,165 7/1979 Schwab ..... 282/27.5

*Primary Examiner*—Bruce H. Hess

*Attorney, Agent, or Firm*—Sughrue, Mion, Zinn, Macpeak & Seas

[57] ABSTRACT

A heat-transfer recording medium is described, which includes a substrate and a two color transfer layer on the substrate, wherein the two color transfer layer contains a solid heat-sensitive ink which melts or sublimates at a relatively low temperature and is transferred to a recording paper as a predetermined color, and a heat-sensitive color-forming ink dispersed in the solid heat-sensitive ink, which melts or sublimates at a relatively high temperature, and is transferred to the recording paper in a color different from the above color.

12 Claims, 2 Drawing Figures

HEAT-TRANSFER RECORDING MEDIUM

BACKGROUND OF THE INVENTION

1. Field of the Invention

The present invention relates to a heat-transfer recording medium which permits the recording of two colors by the utilization of differences in heating temperatures.

2. The Prior Art

In accordance with the heat-transfer recording process, a thermal recording medium coated with an ink which melts or sublimates upon heating is selectively heated according to an information pattern, and the thus melted or sublimated ink is transferred to a recording paper placed on the thermal recording medium, to thereby record the information pattern on the recording paper.

A conventional heat-transfer recording medium which permits recording in two colors by utilizing differences in heating temperature is shown in FIG. 1. Referring to FIG. 1, the heat-transfer recording medium comprises a substrate 1, a first solid heat-sensitive ink layer 2 on the substrate, and a second solid heat-sensitive ink layer 3 on the first solid heat-sensitive ink layer 2. The first solid heat-sensitive ink layer 2 melts upon heating to a temperature of $T_1$°C. Similarly, upon heating to a temperature of $T_2$°C., which is lower than $T_1$°C. ($T_2 < T_1$), the second solid heat-sensitive ink layer 3 melts.

A heat means, e.g., a thermal head, is used to control the heat energy to be supplied to the recording medium. When the recording medium is heated to a temperature which is lower than $T_1$°C. but higher than $T_2$°C., the second solid heat-sensitive ink layer 3 alone melts. If the second solid heat-sensitive ink layer 3 contains red pigment or dye, recording will be performed in red on the recording paper. When the recording medium is heated to a temperature which is higher than $T_1$°C., both ink layers 2 and 3 melt. If the first solid heat-sensitive ink layer 2 contains black pigment or dye, the red and black pigments or dyes will intermix, achieving recording in a black recording color.

The conventional heat-transfer recording medium, however, suffers from a difficulty in that the desired recording color cannot be obtained unless the inks in the two layers are fully mixed, since the solid inks having the different colors are provided in a layered configuration. Therefore, the conventional recording apparatus is designed so that sufficiently great energy can be supplied in order to fully intermix the inks in the two layers. This is one of the factors which inhibits both the miniaturization of the apparatus and high-speed recording.

SUMMARY OF THE INVENTION

The object of the invention is to provide a heat-transfer recording medium for two color recording, which permits the attainment of a constant mixed color within a wide temperature range.

It has been found that the above object can be attained by dispersing, in a solid heat-sensitive ink which melts or sublimates at relatively low termperature, a heat-sensitive color-forming ink which forms a color at temperatures higher that those at the solid heat-sensitive ink melts or sublimates.

The present invention, therefore, relates to a heat-transfer recording medium which includes a substrate, and a two color transfer layer on the substrate, wherein the two color transfer layer contains a solid heat-sensitive ink which melts or sublimates at a relatively low temperature and is transferred to a recording paper in a predetermined color, and a heat-sensitive color-forming ink dispersed in the solid heat-sensitive ink, which melts or sublimates at a relatively high temperature and is transferred to the recording paper in a color different from the above color.

DETAILED DESCRIPTION OF THE INVENTION

The heat-transfer recording medium of the invention will hereinafter be explained in detail with reference to the accompanying drawings.

Figure 1:
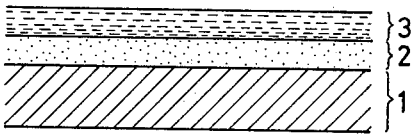
FIG. 1 is an illustrative cross-sectional view of the conventional heat-transfer recording medium for two color recording.
Figure 2:
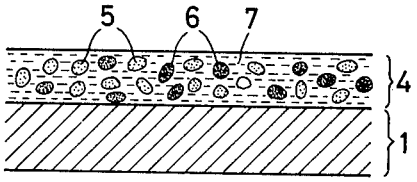
FIG. 2 is an illustrative cross-sectional view of an embodiment of the heat-transfer recording medium of the invention.

Referring to FIG. 2, the recording medium of the invention comprises a substrate 1, e.g., a condenser paper, and a two color transfer layer 4 on the substrate 1. The two color transfer layer 4 is composed of a solid heat-sensitive ink 7, and a number of first microcapsules 5 and second microcapsules 6 which are uniformly dispersed in the solid heat-sensitive ink 7, each microcapsule having a melting point of about 90° C., wherein the first microcapsule 5 contains a colorless fluoran-based dye, and the second microcapsule contain bisphenol. The solid heat-sensitive ink 7 is composed of, e.g., carnauba wax, red dye, and lubricating oil, and melts at about 60° C.

In practice, a recording paper is placed on the heat-transfer recording medium in such a manner that it comes into contact with the two color transfer layer 4, and heat energy is supplied from beneath the substrate 1. When a relatively small amount of heat energy is applied, and the two color transfer layer 4 is heated to a temperature slightly higher than 60° C., the solid heat-sensitive ink 7 melts. A portion of the thus-melted ink penetrates into the fibers of the recording paper and solidifies therein. Thus, the two color transfer layer 4, which is red in color, is transferred to the recording paper in a state such that the first and second microcapsules 5 and 6 are contained as such, and recording is achieved in the red recording color.

On the other hand, when a relatively large amount of heat energy is applied and the two color transfer color layer is heated up to a temperature slightly higher than 90° C., the first and second microcapsules 5 and 6, as well as the solid heat-sensitive ink 7, melt. This causes a reaction of the colorless fluoran-based dye with the bisphenol, which will result in the formation of a black color. At this point, since the solid heat-sensitive ink 7 is in a liquid or sufficiently softened state, intermixing of red and black colors proceeds uniformly and rapidly, and as a result of additive color mixing, the two color transfer layer 4 becomes black in color. Thus, stable recording can be achieved in the black recording color.

In accordance with the invention, as described above, the transfer layer is composed of a solid heat-sensitive ink which melts or sublimates at a relatively low temperature and a heat-sensitive color-forming ink which is dispersed in the solid heat-sensitive ink, which forms a color at a temperature higher than the temperature at which the solid heat-sensitive ink melts or sublimates, and is coated on the substrate as a single layer. This offers an advantage in that the production of the heat-transfer recording medium is simplified.

Although two kinds of capsules containing different substances are dispersed in the solid heat-sensitive ink in the above described embodiment of the invention, only one kind of capsule may be dispersed. For example, when red or white microcapsules containing a black dye are dispersed in a solid heat-sensitive ink containing a red dye, recording can be performed in the red recording color at low temperatures and in a black recording color at high temperatures, as is the case in the above embodiment. Of course, a colorless dye and a color former can be introduced in combination with a binder into the same microcapsule. Furthermore, although the capsules are dispersed in the solid heat-sensitive ink in the above described embodiment, a color former which forms color at high temperatures can be dispersed directly in the solid heat-sensitive ink.

What is claimed is:

1. A heat-transfer recording medium, comprising: a substrate, and a two color transfer layer on the substrate, said two color transfer layer containing a solid heat-sensitive ink which melts or sublimates at a relatively low temperature and is transferred to a recording paper in a predetermined color, and a heat-sensitive color-forming ink dispersed in the solid heat-sensitive ink, which melts or sublimates at a relatively high temperature, and is transferred to the recording paper in a color different from said predetermined color, said color-forming ink comprising a colorless color former and a color developer wherein at least one of the color former and a color developer is encapsulated with microcapsules that melt at a relatively high temperature such that said microcapsules are transferred intact along with the melted or sublimated solid heat-sensitive ink when transfer takes place at said relatively low temperature.

2. A heat-transfer recording medium as claimed in claim 1, said heat-sensitive color forming ink being dispersed throughout said solid heat-sensitive ink and being provided in the form of said microcapsules.

3. A heat-transfer recording medium as claimed in claim 2, said microcapsules being provided in two distinct types.

4. A heat-transfer recording medium as claimed in claim 3, one type of said microcapsules containing a colorless dye, and the other type of said microcapsules containing bisphenol.

5. A heat-transfer recording medium as claimed in claim 3 or 4, the contents of said two types of microcapsules reacting with one another to form said different color.

6. A heat-sensitive recording medium as claimed in claim 3 or 4, said solid heat-sensitive ink being of said predetermined color, said microcapsules also being of said predetermined color, or white, said microcapsules being transferred intact along with said melted or sublimated solid heat-sensitive ink when transfer takes place at said relatively low temperature.

7. A heat-transfer recording medium as claimed in claim 2, wherein said microcapsules contain a dye-precursor capable of forming said different color.

8. A heat-transfer recording medium as claimed in claim 7, said solid heat-sensitive ink being of said predetermined color, said microcapsules also being of said predetermined color, or white, said microcapsules being transferred intact along with said melted or sublimated solid heat-sensitive ink when transfer takes place at said relatively low temperature.

9. A heat-transfer recording medium as claimed in claim 2, wherein said microcapsules contain a colorless dye and a color former, in combination with a binder.

10. A heat-transfer recording medium, comprising: a substrate, and a transfer layer disposed on said substrate; said transfer layer containing a solid heat-sensitive ink of a first color which melts or sublimates at a first temperature and color forming means for forming a second color which melts or sublimates at a second, higher temperature, said color forming means comprising: a colorless color former and a color developer wherein at least one of the color former and a color developer is encapsulated with microcapsules that melt at a relatively high temperature such that said microcapsules are transferred intact along with the melted or sublimated solid heat-sensitive ink when transfer takes place at said relatively low temperature.

11. A heat-transfer recording medium comprising: a substrate, and a transfer layer disposed on said substrate; said transfer dye layer comprising solid, heat-sensitive ink of a first color in which is dispersed encapsulated color forming means for forming a secod color, said color forming means comprising: a colorless color former and a color developer wherein at least one of the color former and a color developer is encapsulated with microcapsules that melt at a relatively high temperature such that said microcapsules are transferred intact along with the melted or sublimated solid heat-sensitive ink when transfer takes place at said relatively low temperature.

12. A heat-transfer recording medium as claimed in claim 11, said color forming means being encapsulated in white capsules or capsules of said first color.

* * * * *